US006103043A

United States Patent [19]

Lin

[11] Patent Number: 6,103,043

[45] Date of Patent: Aug. 15, 2000

[54] PROCESS FOR ATTACHING COLORS AND PRINTS TO STAINLESS STEEL PRODUCT

[76] Inventor: Chieh-Feng Lin, No. 228, Lane 277, Fu Hsing Road, Yung Kang City, Tainan Hsien, Taiwan

[21] Appl. No.: 09/186,651

[22] Filed: Nov. 6, 1998

[51] Int. Cl.[7] ..... B44C 1/165

[52] U.S. Cl. ..... 156/237; 156/230; 156/240; 156/277; 101/34; 427/435

[58] Field of Search ..... 156/230, 155, 156/236, 240, 277, 237; 101/33, 34; 427/149, 430.1, 434.3, 435

[56] References Cited

U.S. PATENT DOCUMENTS 4,010,057 3/1977 Nakanishi ..... 156/230 X
4,231,829 11/1980 Marui et al. ..... 156/230
4,269,650 5/1981 Arai et al. ..... 156/230 X
4,436,571 3/1984 Nakanishi ..... 156/230 X
5,908,525 6/1999 Zaher ..... 156/230
5,916,400 6/1999 Zaher ..... 156/230
6,001,206 12/1999 Zaher ..... 156/230

*Primary Examiner*—Curtis Mayes
*Attorney, Agent, or Firm*—Rosenberg, Klein & Lee

[57] ABSTRACT

Processes for attaching colors and prints to stainless steel product in the present invention comprises actions of: (1) roughening surface with an abrasive paper, (2) cleaning with water, (3) applying priming paint to the stainless steel, (4) hanging the stainless steel on a support, (5) placing a film with colors and prints thereon on water, (6) contacting the stainless steel with the film, (7) washing with cleaning water, (8) drying; and (9) applying gold lacquer in order for the stainless steel to have a shining surface.

1 Claim, 2 Drawing Sheets

(1 of 2 Drawing Sheet(s) Filed in Color)

PROCESS FOR ATTACHING COLORS AND PRINTS TO STAINLESS STEEL PRODUCT

OBJECT OF THE INVENTION

The purpose of the present invention is to provide a method by which stainless product can have predetermined colors or prints attached to it in order for it to have a more beautiful and attractive appearance.

BACKGROUND OF THE INVENTION

Stainless steel is used as a material for many sorts of products, e.g. tableware, and medical apparatus and instruments. Because stainless steel is rustless and have clean appearance, it is very popular in industry. Prior to the processes of the present invention, polishing and etching are the main ways to change colors and grains of a stainless steel product. And it is difficult to attach colors to stainless steel product due to characteristics thereof. Said polishing and etching have been used for tens of years, not having new methods to replace them. This is a bottleneck for the development of stainless steel products.

Therefore, it is a main object of the present invention to provide a way by which colors and prints can be attached to stainless steel product.

SUMMARY

Processes for attaching colors and prints to stainless steel product is provided, comprising following actions:

(1) roughening surface of the stainless steel with an abrasive paper;

(2) cleaning with water;

(3) applying priming paint thereto;

(4) hanging it on a support;

(5) placing a prepared film on water held in a sink, the film having colors and prints attached to it, and being a kind of process resin having watercolor ink, and made by means of PVA intaglio printing, and used along with activator;

(6) placing the stainless steel product onto the film to connect both;

(7) washing with water;

(8) drying; and (9) applying gold lacquer in order for the stainless steel to have a shining surface.

BRIEF DESCRIPTION OF THE DRAWINGS

The file of this patent contains at least one drawing executed in color. Copies of this patent with color drawings will be provided by the Patent and Trademark Office upon request and payment of the necessary fee.

The present invention will be better understood with reference to the accompanying figures, wherein.

DETAILED DESCRIPTION OF THE PREFERRED EMBODIMENTS

Figure 1:
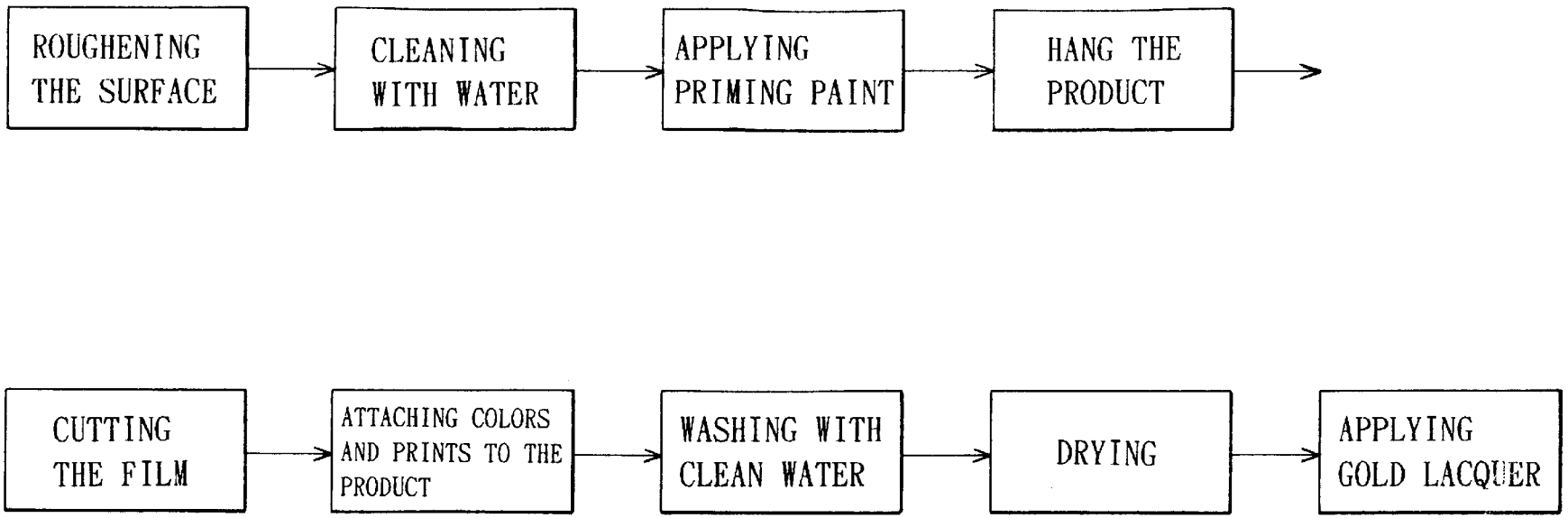
FIG. 1 is a flow chart of the processes of attaching colors and prints to a stainless steel product of the present invention.
Figure 2:
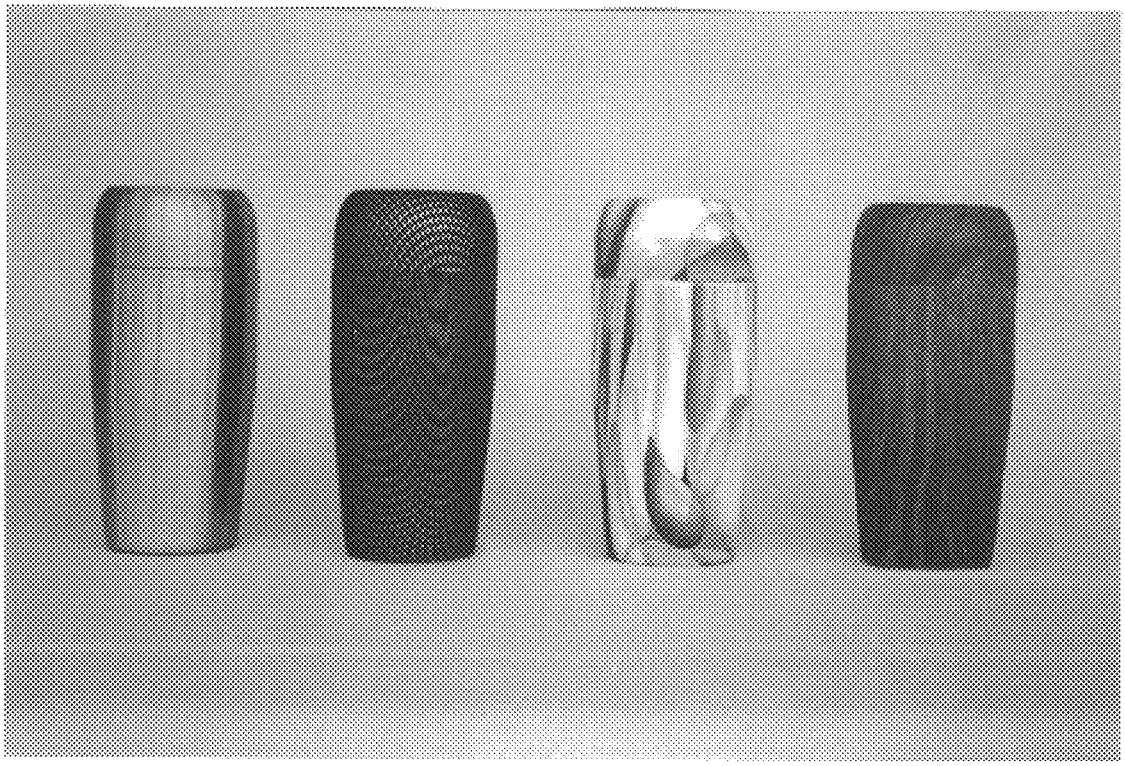
FIG. 2 is a view from left to right showing a stainless steel product without being colored, one with panel print, one with various colors attached thereto, and one with wood grains.

Processes for attaching colors and prints to stainless steel product in the present invention comprises the following actions:

(1) roughening the surface of the stainless steel; the surface of the stainless steel or a product made of stainless steel is roughened with abrasive paper, e.g. an abrasive paper numbered 180, in order for prints and colors to be attached to the surface of the stainless steel more easily and firmly;

(2) cleaning the surface of the stainless steel; the stainless steel or the stainless steel product is cleaned with water such that dirt, dust, grease, and small particles of stainless steel are washed off the surface;

(3) attaching priming paint thereto; priming paint of various colors is attached to the stainless steel or the stainless steel products according to types of the prints; for instance, brown, and yellow priming paint is used in attaching a wood grain print; white, and gray priming paint is used in attaching a marbled print; reddish one is used in attaching a granite print;

(4) hanging the stainless steel or the product on a support; when the priming paint is attached to the stainless steel product, the product is hung on a support with opening thereof facing upward; if the stainless steel product has threads, it can be fixed to a screw of the support; if the stainless steel product is a bottle, it can be hung on the support from the neck thereof;

(5) cutting the coloring and printing material; the color and print are primarily prepared on a roll of film, and the film, is cut according to size of the stainless steel products to be colored and printed; the cut film is then placed on water held in a sink; the film is a kind of processed resin having watercolor ink and made by means of PVA intaglio printing, and is used along with activator; for instance we can mix glutinous rice powder with water completely into a paste, and then apply same on a transparent film in preparation;

(6) attaching the color and print to the stainless steel product; after the film is placed on the water, the film will spread to become larger and soft; then the stainless steel product is placed onto the film slowly, from left side or right side, first forming a slope in relation to the film; thus, the film will cover the product with the colors and prints thereof attached to the product;

(7) washing; the product with the colors and prints attached thereto is then washed with clean water in order to remove unwanted particles, dirt, and dust from it;

(8) drying to finalize the design; the cleaned product is then sent into a drying apparatus with a conveyer, and dried at a temperature of 90° C. to 100° C. such that the colors and prints can be firmly attached to the product;

(9) making the colored and printed product shine; transparent gold lacquer is applied to the product such that the product has a shining appearance.

The above said processes can be used for coloring various products, e.g. bowls, cups, pots, pans, and tableware. The colors and prints to be attached to the stainless steel can be prepared in various patterns, e.g. marbles print, granite print, and wood grain print, such that the product, when the colors, and prints are attached thereto, can look like a marble, granite, or wood product. Moreover, the stainless steel product can still have the advantages of stainless steel after being colored and printed.

What is claimed is:

1. Processes for attaching colors and prints to stainless steel, comprising following actions:

(1) roughening surface of the stainless steel with an abrasive paper in order for the colors and prints to be easily and firmly attached thereto;

(2) cleaning the surface thereof with clean water in order to wash off dust, dirt, grease, and unwanted particle;

(3) attaching priming paint thereto;

(4) hanging the stainless steel on a support;

(5) cutting a film having colors and prints thereon; said film being cut according to size of said stainless steel and placed on water held in a sink after having been cut, said film being a kind of processed resin having water-color ink and made by means of PVA intaglio printing, and being used along with activator;

(6) attaching said colors and prints to said stainless steel; said stainless steel being placed onto said film on the water for said colors and prints to be attached thereto;

(7) washing the stainless steel with clean water to remove dirt, and unwanted particle therefrom;

(8) drying the stainless steel with a drying apparatus for the colors and prints to be firmly attached thereto; and (9) applying a transparent gold lacquer to the stainless steel in order for the same to having a shining surface.

* * * * *